US006079586A

United States Patent [19]

Hanneman

[11] Patent Number: 6,079,586

[45] Date of Patent: Jun. 27, 2000

[54] COMBINATION CUP AND FOOD CONTAINER

[76] Inventor: Amy L. Hanneman, 707 SW. 18th St., Blue Springs, Mo. 64015

[21] Appl. No.: 09/292,573

[22] Filed: Apr. 15, 1999

[51] Int. Cl.[7] ..... B65D 1/24; B65D 77/08; A47G 19/22

[52] U.S. Cl. ..... 220/526; 220/254; 220/703; 220/717; 206/217; 426/115; 426/120; 222/129

[58] Field of Search ..... 220/523–526, 220/212, 254, 256, 259, 826, 703, 705, 711, 713, 716, 717; 215/6, 228, 387–389; 206/217, 541, 216; 426/115, 120; 222/129, 481

[56] References Cited

U.S. PATENT DOCUMENTS

| | | | |
|---|---|---|---|
| 950,844 | 3/1910 | Dolan | 220/526 |
| 4,946,062 | 8/1990 | Coy | 220/254 |
| 4,955,503 | 9/1990 | Propes | 220/526 |
| 5,186,347 | 2/1993 | Freeman et al. | 220/254 |
| 5,490,608 | 2/1996 | Hawkins | 220/524 |
| 5,706,980 | 1/1998 | Dickerson | 222/129 |
| 5,753,289 | 5/1998 | Ness | 220/525 |
| 5,799,838 | 9/1998 | Miller | 220/254 |
| 5,921,440 | 7/1999 | Maines | 222/129 |
| 5,992,677 | 11/1999 | Ebine | 220/524 |

*Primary Examiner*—Nathan J. Newhouse

[57] ABSTRACT

A combination cup and food container for holding a liquid beverage and a dry food snack in a single unit. The combination cup and food container includes a container having an open top and a partition dividing the container into a pair of compartments. A lid substantially covers the top of the container. The lid has an upwardly extending mouth spout forming an opening through the lid. The mouth spout is positioned above a first of the compartments of the container to permit liquids in the first compartment to pass through the mouth spout. The lid has a hole therethrough. The hole of the lid is positioned above a second of the compartments of the container. The lid has a flap substantially covering the hole of the lid. The flap is pivotally coupled to the lid.

9 Claims, 2 Drawing Sheets

COMBINATION CUP AND FOOD CONTAINER

BACKGROUND OF THE INVENTION

1. Field of the Invention

The present invention relates to combination cup and food containers and more particularly pertains to a new combination cup and food container for holding a liquid beverage and a dry food snack in a single unit.

2. Description of the Prior Art

The use of combination cup and food containers is known in the prior art. More specifically, combination cup and food containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,753,289; U.S. Pat. No. 3,567,105; U.S. Pat. No. 4,993,584; U.S. Pat. No. 3,288,344; U.S. Pat. No. 5,180,079; and U.S. Pat. No. 5,241,835.

While these devices fulfill their respective, particular objectives and requirements, the aforementioned patents do not disclose a new combination cup and food container. The inventive device includes a container having an open top and a partition dividing the container into a pair of compartments. A lid substantially covers the top of the container. The lid has an upwardly extending mouth spout forming an opening through the lid. The mouth spout is positioned above a first of the compartments of the container to permit liquids in the first compartment to pass through the mouth spout. The lid has a hole therethrough. The hole of the lid is positioned above a second of the compartments of the container. The lid has a flap substantially covering the hole of the lid. The flap is pivotally coupled to the lid.

In these respects, the combination cup and food container according to the present invention substantially departs from the conventional concepts and designs of the prior art, and in so doing provides an apparatus primarily developed for the purpose of holding a liquid beverage and a dry food snack in a single unit.

SUMMARY OF THE INVENTION

In view of the foregoing disadvantages inherent in the known types of combination cup and food containers now present in the prior art, the present invention provides a new combination cup and food container construction wherein the same can be utilized for holding a liquid beverage and a dry food snack in a single unit.

The general purpose of the present invention, which will be described subsequently in greater detail, is to provide a new combination cup and food container apparatus and method which has many of the advantages of the combination cup and food containers mentioned heretofore and many novel features that result in a new combination cup and food container which is not anticipated, rendered obvious, suggested, or even implied by any of the prior art combination cup and food containers, either alone or in any combination thereof.

To attain this, the present invention generally comprises a container having an open top and a partition dividing the container into a pair of compartments. A lid substantially covers the top of the container. The lid has an upwardly extending mouth spout forming an opening through the lid.

The mouth spout is positioned above a first of the compartments of the container to permit liquids in the first compartment to pass through the mouth spout. The lid has a hole therethrough. The hole of the lid is positioned above a second of the compartments of the container. The lid has a flap substantially covering the hole of the lid. The flap is pivotally coupled to the lid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination cup and food container apparatus and method which has many of the advantages of the combination cup and food containers mentioned heretofore and many novel features that result in a new combination cup and food container which is not anticipated, rendered obvious, suggested, or even implied by any of the prior art combination cup and food containers, either alone or in any combination thereof.

It is another object of the present invention to provide a new combination cup and food container which may be easily and efficiently manufactured and marketed.

It is a further object of the present invention to provide a new combination cup and food container which is of a durable and reliable construction.

An even further object of the present invention is to provide a new combination cup and food container which is susceptible of a low cost of manufacture with regard to both materials and labor, and which accordingly is then susceptible of low prices of sale to the consuming public, thereby making such combination cup and food container economically available to the buying public.

Still yet another object of the present invention is to provide a new combination cup and food container which provides in the apparatuses and methods of the prior art some of the advantages thereof, while simultaneously overcoming some of the disadvantages normally associated therewith.

Still another object of the present invention is to provide a new combination cup and food container for holding a liquid beverage and a dry food snack in a single unit.

Yet another object of the present invention is to provide a new combination cup and food container which includes a container having an open top and a partition dividing the container into a pair of compartments. A lid substantially covers the top of the container. The lid has an upwardly extending mouth spout forming an opening through the lid. The mouth spout is positioned above a first of the compartments of the container to permit liquids in the first compartment to pass through the mouth spout. The lid has a hole therethrough. The hole of the lid is positioned above a second of the compartments of the container. The lid has a flap substantially covering the hole of the lid. The flap is pivotally coupled to the lid.

Still yet another object of the present invention is to provide a new combination cup and food container that allows a parent give a child a single container having both a beverage therein and a food snack separated from the beverage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 4 thereof, a new combination cup and food container embodying the principles and concepts of the present invention will be described.

As best illustrated in FIGS. 1 through 4, the combination cup and food container generally comprises a container having an open top and a partition dividing the container into a pair of compartments. A lid substantially covers the top of the container. The lid has an upwardly extending mouth spout forming an opening through the lid. The mouth spout is positioned above a first of the compartments of the container to permit liquids in the first compartment to pass through the mouth spout. The lid has a hole therethrough. The hole of the lid is positioned above a second of the compartments of the container. The lid has a flap substantially covering the hole of the lid. The flap is pivotally coupled to the lid.

In closer detail the combination cup and food container includes a container 10 having a generally circular open top 11 and a generally circular bottom 12. In a preferred embodiment, the container is generally frusta-conical in shape and tapers from the top of the container to the bottom of the container. In an ideal illustrative embodiment, the container has a length defined between the top and bottom of the container of about 6 inches. In this ideal illustrative embodiment, the top of the container has an outer diameter of about 2½ inches.

Figure 3:
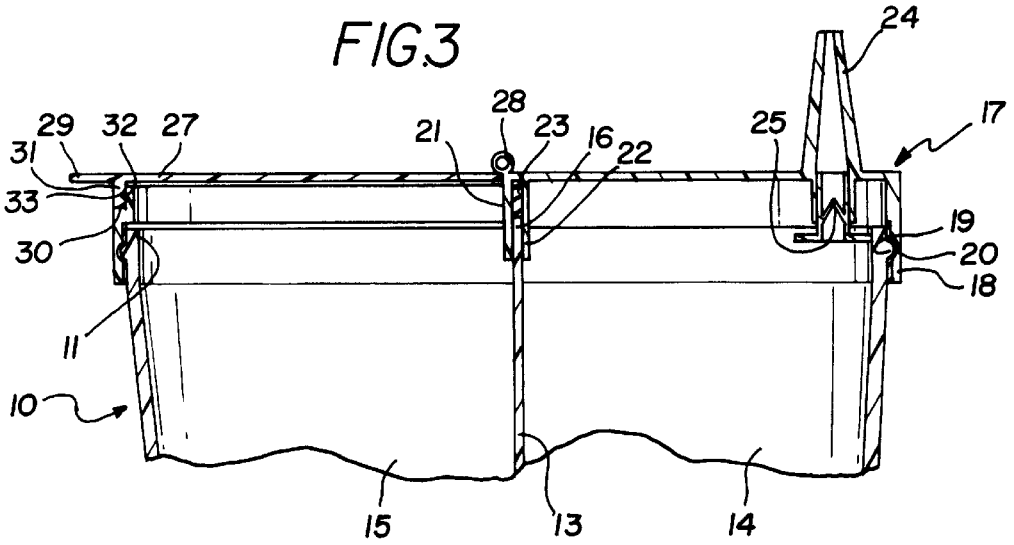
FIG. 3 is a schematic partial cross sectional view of the present invention taken from line 3-3 of FIG. 3.

The container has a planar partition 13 therein extending between the top and bottom container. The partition is preferably extended across a diameter of the container. The partition of the container divides the container into a pair of completely separate compartments 14,15 each having a generally semi-circular transverse cross section. A first compartment 14 of the pair of compartments is designed for holding a liquid beverage therein, and a second compartment 15 of the pair of compartments is designed for holding a dry foodstuff snack therein. As best illustrated in FIG. 3, the partition preferably has an upper edge 16 upwardly extending from a plane defined by the top of the container.

Figure 1:
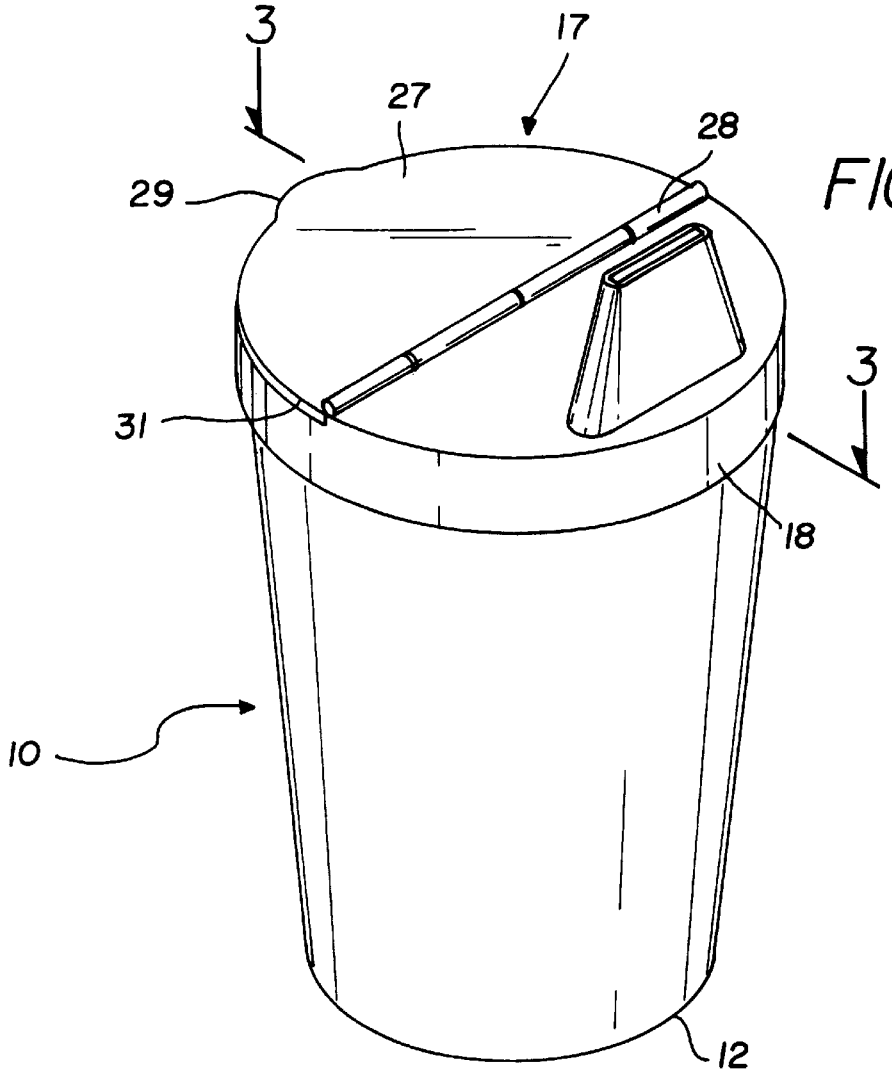
FIG. 1 is a schematic perspective view of a new combination cup and food container according to the present invention.
Figure 2:
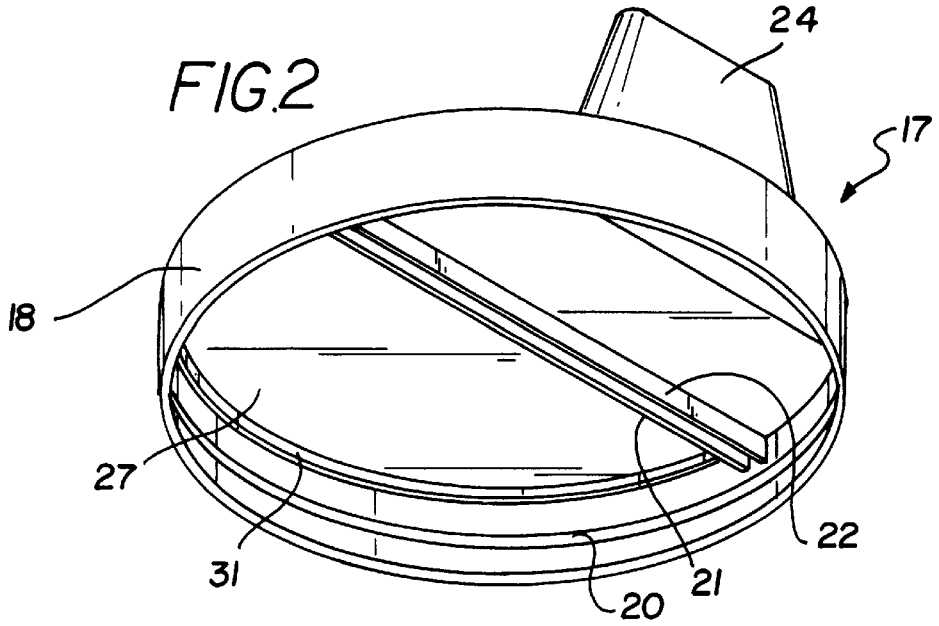
FIG. 2 is a schematic perspective view of the bottom of the lid.

The combination cup and food container also includes a lid 17 substantially covering the top of the container. The lid preferably has a generally circular outer perimeter and a downwardly extending annular resilient lip 18 along the outer perimeter of the lid. The lip of the lid is positioned around the top of the container. Preferably, as best illustrated in FIG. 3, the container preferably has an outwardly radiating resilient annular outer ridge 19 extending therearound adjacent the top of the container. Similarly, as best illustrated in FIGS. 2 and 3, the lip has an annular inner groove 20 therearound. The outer ridge of the container is inserted into the inner groove of the lip to releasably hold lid to the top of the container and to form a seal between the lip of the lid and the top of the container.

The lid has a spaced apart pair of substantially parallel receiving walls 21,22 downwardly extending therefrom and extending between diametrically opposite portions of the lip of the lid. The receiving walls of the lid define a downwardly facing receiving channel therebetween. As illustrated in FIG. 3, the upper edge of the partition is inserted into the receiving channel to close passage between the compartments between the partition and the lid. Preferably, the lid has a resiliently deformable rubber or plastic strip 23 disposed in the receiving channel and positioned between the lid and the upper edge of the partition to provide a seal between the upper edge of the partition and the lid in the receiving channel.

The lid has an upwardly extending mouth spout 24 forming an opening through the lid. The mouth spout is positioned towards the outer perimeter of the lid. Preferably, the mouth spout tapers upwards away from lid to an open upper end of the mouth spout for providing more comfort when inserted into the mouth of a user. Ideally, the mouth spout has a generally oblong transverse cross section with rounded ends taken in a plane parallel to the plane of the lid. The mouth spout is positioned above the first compartment of the container to permit liquids in the first compartment to pass through the mouth spout. Optionally, the mouth spout may have a valve 25 therein for selectively closing the mouth spout to prevent spillage of liquid from the first compartment via the mouth spout when the container is tipped over. In use, the valve is designed to open when a user sucks on the mouth spout.

The lid also has a generally semi-circular hole 26 therethrough. The hole of the lid is spaced apart from mouth spout of the lid and is positioned above the second compartment of the container to provide access to foodstuffs held in the second container. The hole of the lid preferably has a generally semicircular periphery comprising a generally semi-circular arcuate portion and a substantially straight elongate portion extending between opposite ends of the arcuate portion of the periphery of the hole. The arcuate portion of the periphery of the hole is extended along a corresponding semi-circular portion of the outer perimeter of the lid positioned adjacent the second compartment of the container and opposite the mouth spout of the lid. The elongate portion of the periphery of the hole is extended across a diameter of the lid substantially parallel to the receiving channel of the lid.

The lid has a generally semi-circular rigid flap 27 substantially covering the hole of the lid. Like the hole, the flap also has a generally semi-circular outer perimeter comprising a generally semi-circular arcuate portion and a substantially straight elongate portion extending between opposite ends of the arcuate portion of the perimeter of the flap. The arcuate portion of the perimeter of the flap is positioned adjacent the arcuate portion of the periphery of the hole and the elongate portion of the perimeter of the flap is positioned adjacent the elongate portion of the periphery of the hole.

The elongate portion of the flap is pivotally coupled to the lid by a piano-type hinge 28 along the elongate portion of the periphery of the hole of the lid. The flap also preferably has a generally semi-circular lifting tab 29 outwardly extending therefrom the arcuate portion of the perimeter of the flap and in an opposite direction away from the mouth spout side of the lid. In use, the lifting tab is designed for helping a user pivot the flap open and closed over the hole of the lid.

Figure 4:
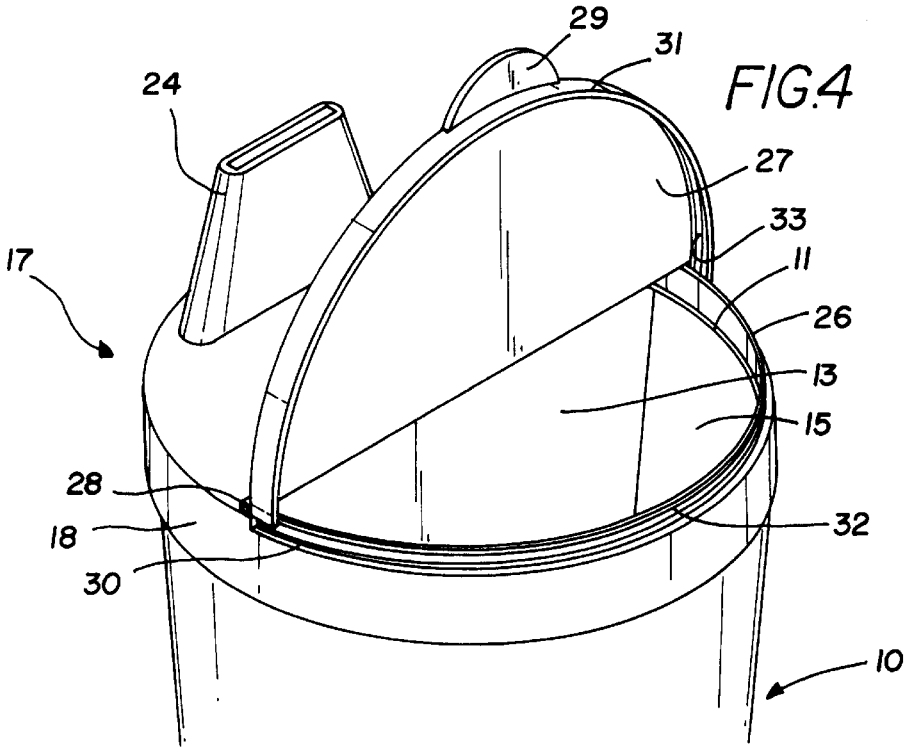
FIG. 4 is a schematic partial perspective view of the present invention with the flap lifted open to provide access to the foodstuff compartment via the hole of the lid.

In a preferred embodiment, the outer perimeter of the lid has an arcuate shoulder 30 therein extending adjacently along the arcuate portion of the periphery of the hole of the lid as best depicted in FIG. 4. The flap has a corresponding downwardly extending arcuate end lip 31 along the arcuate portion of the outer perimeter of the flap. The shoulder of the lid receives therein the end lip of the flap preferably so that the exterior of the end lip is flush with the exterior of the adjacent portion of the lip of the lid.

In an ideal embodiment, the shoulder of the lid has an elongate outer ridge 32 therein and the end lip of the flap has an elongate resilient inner groove 33. The inner groove of the end lip of the flap receives into the outer ridge of the shoulder of the lid to releasably hold the flap in a closed position over the hole of the lid.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination:

a container having an open top and a partition dividing said container into a pair of compartments;

a lid substantially covering said top of said container;

said lid having an upwardly extending mouth spout forming an opening through said lid, said mouth spout being positioned above a first of said compartments of said container to permit liquids in said first compartment to pass through said mouth spout;

said lid having a hole therethrough, said hole of said lid being positioned above a second of said compartments of said container; and said lid having a flap substantially covering said hole of said lid, said flap being pivotally coupled to said lid.

2. The combination of claim 1, wherein said container is generally frusta-conical in shape and tapers downwards from said top of said container.

3. The combination of claim 1, wherein said container has an outwardly radiating resilient outer ridge extending therearound adjacent said top of said container, wherein said lid has a downwardly extending lip therearound, wherein said lip has an inner groove therearound, and wherein said outer ridge of said container is inserted into said inner groove of said lip.

4. The combination of claim 1, wherein said flap has a lifting tab outwardly extending therefrom.

5. The combination of claim 1, wherein said partition has an upper edge upwardly extending from a plane defined by said top of said container, wherein said lid has a downwardly facing receiving channel, and wherein said upper edge of said partition is inserted into said receiving channel of said lid.

6. The combination of claim 5, wherein said lid has a spaced apart pair of substantially parallel receiving walls downwardly extending therefrom, said receiving walls of said lid defining said receiving channel therebetween.

7. The combination of claim 1, wherein said lid having a shoulder therein adjacent said hole of said lid, wherein said flap has a downwardly extending end lip, wherein said shoulder of said lid receives therein said end lip of said flap.

8. The combination of claim 7, wherein said shoulder of said lid has an elongate outer ridge, wherein said end lip of said flap has an elongate resilient inner groove therein, and wherein said inner groove of said end lip of said flap receives said outer ridge of said shoulder of said lid therein.

9. In combination:

a container having a generally circular open top and a generally circular bottom, said container being generally frusta-conical in shape and tapering from said top of said container to said bottom of said container;

said container having a planar partition therein extending between said top and bottom container;

said partition of said container dividing said container into a pair of compartments;

said partition having an upper edge upwardly extending from a plane defined by said top of said container;

said container having an outwardly radiating resilient annular outer ridge extending therearound adjacent said top of said container;

a lid substantially covering said top of said container;

said lid having a generally circular outer perimeter and a downwardly extending annular lip along said outer perimeter of said lid;

said lip of said lid being positioned around said top of said container, said lip having an annular inner groove therearound, said outer ridge of said container being inserted into said inner groove of said lip to releasably hold lid to said top of said container;

said lid having a spaced apart pair of substantially parallel receiving walls downwardly extending therefrom and extending between diametrically opposite portions of said lip of said lid;

said receiving walls of said lid defining a downwardly facing receiving channel therebetween, said upper edge of said partition being inserted into said receiving channel;

said lid having an upwardly extending mouth spout forming an opening through said lid, said mouth spout being positioned towards said outer perimeter of said lid;

said mouth spout being positioned above a first of said compartments of said container to permit liquids in said first compartment to pass through said mouth spout;

said lid having a generally semi-circular hole therethrough, said hole of said lid being spaced apart from mouth spout of said lid, said hole of said lid being positioned above a second of said compartments of said container;

said lid having a generally semi-circular flap substantially covering said hole of said lid;

said flap being pivotally coupled to said lid;

said flap having a lifting tab outwardly extending therefrom;

said outer perimeter of said lid having an arcuate shoulder therein adjacent said hole of said lid;

said flap having a downwardly extending arcuate end lip;

said shoulder of said lid receiving therein said end lip of said flap; and said shoulder of said lid having an elongate outer ridge, said end lip of said flap having an elongate resilient inner groove therein, and said outer ridge of said shoulder of said lid being inserted into said inner groove of said end lip of said flap.

* * * * *